US008479325B2

(12) United States Patent
Gardenier et al.

(10) Patent No.: US 8,479,325 B2
(45) **Date of Patent: *Jul. 9, 2013**

(54) SPA TUB COVER AND LIFTER SYSTEM

(75) Inventors: W. John Gardenier, Wallingford, CT (US); Andrew Tournas, Bethany, CT (US)

(73) Assignee: Hottubproducts.com, LLC, Prospect, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/464,040

(22) Filed: May 4, 2012

(65) Prior Publication Data

US 2012/0233763 A1 Sep. 20, 2012

Related U.S. Application Data

(63) Continuation of application No. 13/300,774, filed on Nov. 21, 2011, which is a continuation-in-part of application No. 12/958,455, filed on Dec. 2, 2010, and a continuation-in-part of application No. 12/958,554, filed on Dec. 2, 2010.

(51) Int. Cl.
*E04H 4/00* (2006.01)

(52) U.S. Cl.
USPC ..... 4/498; 4/500; 4/503; 4/557; 4/580

(58) Field of Classification Search
USPC ..... 4/498–503, 494, 496, 557, 580; 52/64–72
See application file for complete search history.

(56) References Cited

U.S. PATENT DOCUMENTS

| | | | | |
|---|---|---|---|---|
| 1,658,044 A | | 2/1928 | Fagan | |
| 5,086,525 A | * | 2/1992 | Christopher | 4/498 |
| 5,367,722 A | | 11/1994 | Pesterfield | |
| 5,566,403 A | | 10/1996 | Black et al. | |
| 5,644,803 A | | 7/1997 | Wilson | |

(Continued)

FOREIGN PATENT DOCUMENTS

| | | | |
|---|---|---|---|
| AT | 004379 | U1 | 6/2001 |
| WO | WO2009/129756 | A2 | 10/2009 |

OTHER PUBLICATIONS

Adult Foam Furnishings, ZFurniture.Com, downloaded Jul. 28, 2010, available at http://www.zfurniture.com/elite-products--foam-furniture--adult-foam-furnishings.htm.

(Continued)

*Primary Examiner* — Gregory Huson
*Assistant Examiner* — Erin Deery
(74) *Attorney, Agent, or Firm* — Gordon & Jacobson, PC

(57) ABSTRACT

A spa cover includes first and second spa cover portions that are rotatable along a pivot axis. The first spa cover portion has a first length traverse to the pivot axis, and the second spa cover portion has a second length extending in the same direction as the first length. The first length is longer than the second length. When the cover is moved from a closed configuration into an open configuration, lower surfaces of the first and second spa cover portions, which face the water at the interior of the spa tub when in the closed configuration and can become unsightly, are moved into a position in which they face each other, whereas the upper surface of the second spa cover portion faces the users in the tub. A lifter is provided for moving the spa cover between the closed and an open configurations.

21 Claims, 13 Drawing Sheets

U.S. PATENT DOCUMENTS

| | | | | |
|---|---|---|---|---|
| 5,689,841 | A | 11/1997 | Black et al. | |
| 5,819,332 | A | 10/1998 | Perry | |
| 5,950,252 | A | 9/1999 | Fettes | |
| 5,974,600 | A | 11/1999 | Pucci et al. | |
| 5,996,137 | A | 12/1999 | Genova | |
| 6,000,071 | A | 12/1999 | Fettes | |
| 6,158,063 | A | 12/2000 | Tudor | |
| 6,665,890 | B1 | 12/2003 | Tedrick | |
| 6,795,984 | B1 | 9/2004 | Brady | |
| 6,842,917 | B1 * | 1/2005 | Genova | 4/498 |
| 7,055,186 | B2 | 6/2006 | Lauter et al. | |
| 7,073,213 | B2 | 7/2006 | Duarte et al. | |
| 7,281,280 | B2 | 10/2007 | Lahay | |
| 7,290,297 | B2 | 11/2007 | Cunerty | |
| 7,490,370 | B2 | 2/2009 | Macey et al. | |
| 7,721,361 | B1 | 5/2010 | Shubert | |
| 2004/0034915 | A1 * | 2/2004 | Tedrick | 4/498 |
| 2007/0209103 | A1 | 9/2007 | Buzzetti et al. | |
| 2007/0209104 | A1 | 9/2007 | Buzzetto et al. | |
| 2008/0125195 | A1 | 5/2008 | Maenpaa | |
| 2009/0313751 | A1 | 12/2009 | Livingston | |

OTHER PUBLICATIONS

Folding Beds, foamorder.com®, downloaded Jul. 28, 2010, available at http://www.foamorder.com/trifolds.html.

Fold able Foam Mattress M_(AVI), downloaded Jul. 28, 2010, available at http://www.foldingbed.net/khxc/ccp0-prodshow/m_avi.html.

Replacement Covers, catalog description, ThermoSpas, Innovations Everything for the Spa Owner Admitted prior art.

ThermoLift 200, catalog description, ThermoSpas, Innovations Everything for the Spa Owner Admitted prior art.

ThermoLift 300, catalog description, ThermoSpas, Innovations Everything for the Spa Owner Admitted prior art.

Pionier PAMAG, Whirlpool-Cover Automatic "Folder II", product description, downloaded Dec. 15, 2010, (2 pages) available at: http://www.pionier.ch/content/pionier_content/02_produkte/abdeckungen/whirlpool-motorisiert/whrilpool-motorisiert.php?language=EN.

Eclipse ad by Sirem, Automatic Cover for Spas, Nov. 2010.

* cited by examiner

SPA TUB COVER AND LIFTER SYSTEM

CROSS-REFERENCE TO RELATED APPLICATIONS

This application is a continuation of U.S. Ser. No. 13/300,774, filed Nov. 21, 2011, which is a continuation-in-part of U.S. Ser. Nos. 12/958,455 and 12/958,554, which were both filed on Dec. 2, 2010, and all of which are hereby incorporated by reference herein in their entireties.

BACKGROUND OF THE INVENTION

1. Field of the Invention

This invention relates broadly to spa tubs. More particularly, this invention relates to covers for spa tubs and systems for lifting and replacing a spa tub cover relative to a portable spa tub.

2. State of the Art

Spa tubs are frequently used for relaxation, physical therapy, personal enjoyment, and for social occasions. One of the appealing attributes of a spa tubs is that the tub includes jets that direct warm pressurized water toward an interior portion of the tub. Water that exits the jets and contacts the user's skin can create a massaging effect that is pleasurable, and even rehabilitative.

Spa tubs come in two forms: permanent in-ground installations and 'portable' above-ground installations. Portable spa tubs include a frame that supports a molded tub shell, and a cabinet surrounding the frame. The tub shell has an upper boundary rim, a plurality of seating locations defined by seat bottoms and backs and reclining lounges, and a lower floor. At one or more of the seating locations hydrotherapy jets are installed and a suction fitting is provided near the floor. Between the spa shell and the cabinet a space is defined in which plumbing and manifolds are provided to connect the jets, as well as one or more water pumps that circulate the water and a heater that heats the water circulated by the water pumps.

Referring to prior art FIGS. 1-2, for purposes of energy efficiency and readiness of use, it is common to provide the spa 10 with an insulative cover 12 that limits heat loss from the water when the spa is not in use. Such a spa cover 12 includes first and second portions 14, 16 of equal size that together are sized to seat on and cover the upper rim 18 of the spa tub shell 20. Each of the first and second portions 14, 16 are constructed of insulative foam slabs provided within a water-resistant vinyl casing material. The second portion 16 is movable relative to the first portion 14 on a living hinge 22 that connects the first and second portions at their opposing inside upper corners 24, 26 so that the first portion 14 can be folded back over the second portion 16 (FIG. 2). The hinge 22 is constructed of the same vinyl material as the casing material. In order to prevent premature wear of the hinge 22 during folding, the hinge is sufficiently wide to prevent it from being subjected to excessive strain. This creates a gap 28 between the first and second portions when the cover is in the closed configuration. 'Premium' spa covers may include a spacer 30 to limit heat loss from the gap. However, such a spacer 30 does not entirely prevent heat loss at the gap. The spa cover 12 may also include a skirt 32 that further assists in preventing heat loss from around the perimeter of the spa tub. The skirt 32 also prevents heat damage to the tub shell 20, particularly at or near the rim 18, which can become heat-damaged if exposed to sunlight for long periods of time without protection.

To remove the spa cover 12, the second portion 16 is folded back onto the first portion 14. The first and second portions are then together lifted off the spa 10. Often a cover lifter 34 (FIG. 3) is provided for mechanical advantage to assist a user in lifting the cover and to temporarily hold the cover in a folded generally vertically orientation during spa use. The cover lifter seats on the cover and provides a bar which extends over the hinge and about which the second portion is folded back onto the first portion. The bar is then rotated to lift and support the cover at the hinge.

Once the spa cover 12 is lifted, it is appreciated that the upper surfaces 36, 38 of the first and second cover portions 14, 16, as designated in the flat (or closed) configuration of the cover, are now located in the middle and in contact, whereas the lower surfaces (underside water facing surfaces) 40, 42 are facing outwardly from each other. It is not uncommon for the lower surfaces 40, 42 to become discolored by fading or staining due to long-term placement over the spa tub water. As a result, when the folded cover 12 is raised for use of the spa (prior art FIG. 3), the unsightly discolored lower surface 40 of the first portion 14 faces the users in the tub 10.

In addition to heat conservation, spa covers are also important for safety reasons. Spa covers include child-locks, such as child-resistant strap locks 44, that retain the cover 12 over the spa tub 10 by engagement in latches 46 to prevent children from entering the tub when the cover is down. With the cover design shown in prior art FIG. 2, multiple locks 44 are required to hold down the cover 12; at least one lock is required for each of the first and second portions 14, 16, and more commonly two locks are provided to each such portion, particularly adjacent the corners (for a total of four locks), to prevent the respective cover portion from being lifted in a manner that would permit a child to enter under the corners of the cover and into the tub.

SUMMARY OF THE INVENTION

A spa tub cover and cover lifter for use with a portable spa tub are provided. The spa tub cover includes first and second portions that are coupled about a hinge. The first portion has a first lower surface that faces the water in the spa tub and an opposed first upper surface. The first portion includes lateral sides extending between the first upper and first lower surfaces, and which extend transverse to the first lower surface in a lengthwise dimension. The first portion also includes an inner side extending transverse to both the first lower surface and the lateral sides as well as an outer side extending parallel to and facing opposite the inner side. The inner side extends in a widthwise dimension between the lateral sides. A first length is defined as the distance between the inner side and the outer side of the first portion. A first width is defined as the distance between lateral sides of the second portion along the inner side.

The second portion of the cover includes corresponding surfaces to the first portion, with a second lower surface that faces the tub water and an opposed second upper surface. Lateral sides extend between the second lower and upper surfaces in a lengthwise dimension. An inner side extends transverse to the second lower surface in a widthwise dimension. The inner side of the second portion faces the inner side of the first portion. The second portion also includes an outer side extending between the first and second lateral sides and facing opposite the inner side of said first portion. A second length is defined as the distance between the inner side and the outer side of the second portion. A second width is defined as the distance between lateral sides of the second portion along the inner side. In accord with one aspect of the invention, the first and second widths are the same, and the first length is greater than the second length.

The first and second portions are coupled together with a hinge. The hinge extends along the first and second portions in a direction parallel to the first and second widths. The hinge is preferably a living hinge connected to the lower surfaces of the first and second portions. When the cover is in a flat (or closed) configuration, the first and second lower surfaces are co-planar and seat adjacent one another on an upper rim of a spa tub forming a seal about the rim. When the cover is moved into a folded (or open) configuration, the lower surfaces which face the water when in the closed configuration and can be unsightly, are moved into a position in which they face each other, whereas the upper surface of the second portion faces the users in the tub. Given that the first and second sides have different lengths, when the cover is in the open configuration, the first and second outer sides are longitudinally displaced from one another such that they are not coplanar.

The lifter facilitates lifting the cover from the closed configuration to the open configuration. The lifter includes a mount positionable relative to the spa tub. The mount may be fixed to the frame and/or cabinet of the spa tub, or may be provided on a stable support adjacent the spa tub. A first support element of the lifter is rotatable about a pivot axis and is connected to the first upper surface of the first portion. The first portion of the cover includes one or more of a sleeve, a pocket or an open slit at which a frame member of the lifter can be coupled relative to the cover. The sleeve or pocket is particularly suitable for receiving a bar-like support element. The open slit is particularly suitable for receiving a portion of a clamp mechanism for clamping a peripheral portion of the cover. In accord with another preferred aspect of the invention, a second support element extends from the mount and adjacent the outer surface of the first portion of the cover so that when the cover is rotated into the open configuration, the weight of the spa cover is preferably at least partially supported directly on or over the second support.

According to another aspects of the invention, a shield is coupled to the first upper surface of the first portion and movable relative to the second upper surface of the second portion. As such, when the cover is moved into the open configuration, the opening between the first and second inner surfaces remains covered by the shield. This prevents environmental debris, such as leaves, from falling into the hinge during use.

Because the upper surface of the second portion faces the users of the spa tub when the cover is in the open position, according to another aspect of the invention at least one audio and/or video device is disposed at least partially within the upper surface of the second portion. Such a device can include a television, video or computer monitor, amplifier, speakers, etc. The cover may include flaps or other structure which cover such device when not in use.

According to yet another aspect of the invention, given the manner in which the cover moves toward an open configuration, the cover lifter can be configured to orient the first portion of the cover transverse to the upper rim of the spa tub, and suspend the second portion of the cover over the spa tub; i.e., the second lower surface is preferably substantially parallel to, but vertically displaced from the upper rim. The first portion may include a bracket for releasably receiving an arm that supports the second portion in the suspended position. This allows the second portion of the spa cover to function as a sunshade. Further, a supplemental shade may be integrated into or coupled to the second portion of the cover such that it may extend therefrom to provide additional shade over the spa tub.

In addition, a larger cover system is provided for covering an elongate swim spa tub. Such cover system includes a first cover having first and second portions as described above, and a second cover having first and second portions also as described above. Each cover has its own associated lifter at opposite ends of the spa tub, and the first and second covers are oriented so that the respective second portions meet at the middle of the spa tub. When the lifters are operated to move the first and second covers into a closed configuration, the ends of the second portions of the first and second covers are forceably contacted against each other. The ends of the second portions are formed of a softer insulative material that compresses when moved into the closed configuration; this ensures continuity of seal across the spa tub between the first and second cover and about the entire periphery of the spa tub at the rim of the tub. Furthermore, a single lock mechanism is provided that can lock down the entire cover system to prevent unintended usage of the spa.

Additional objects and advantages of the invention will become apparent to those skilled in the art upon reference to the detailed description taken in conjunction with the provided figures.

BRIEF DESCRIPTION OF THE DRAWINGS

Prior art

Prior art

Prior art

DETAILED DESCRIPTION OF THE PREFERRED EMBODIMENTS

Figure 1:
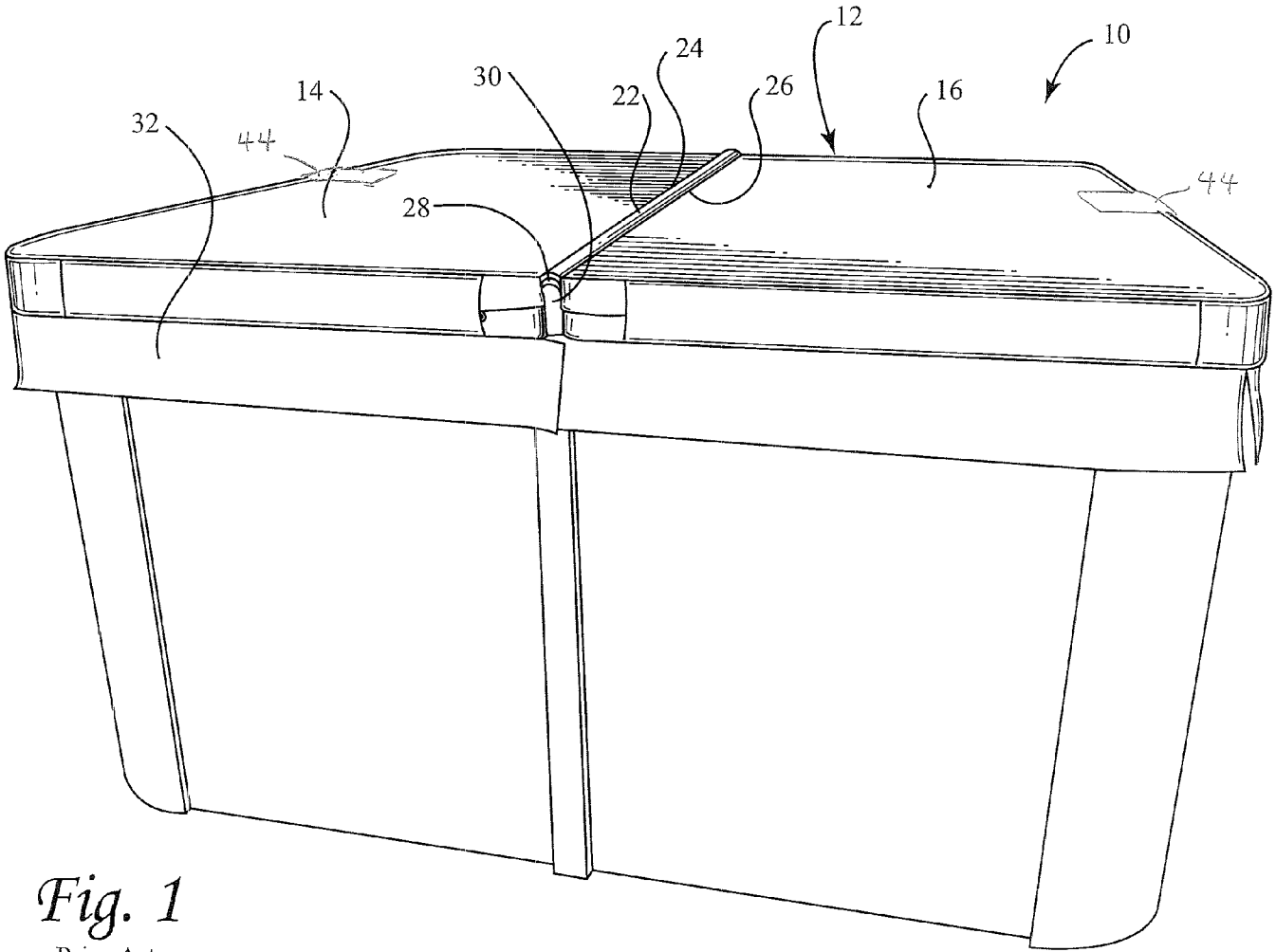
Fig. 1 Prior Art
FIG. 1 is a perspective view of a spa tub provided with a prior art insulative cover.
Figure 2:
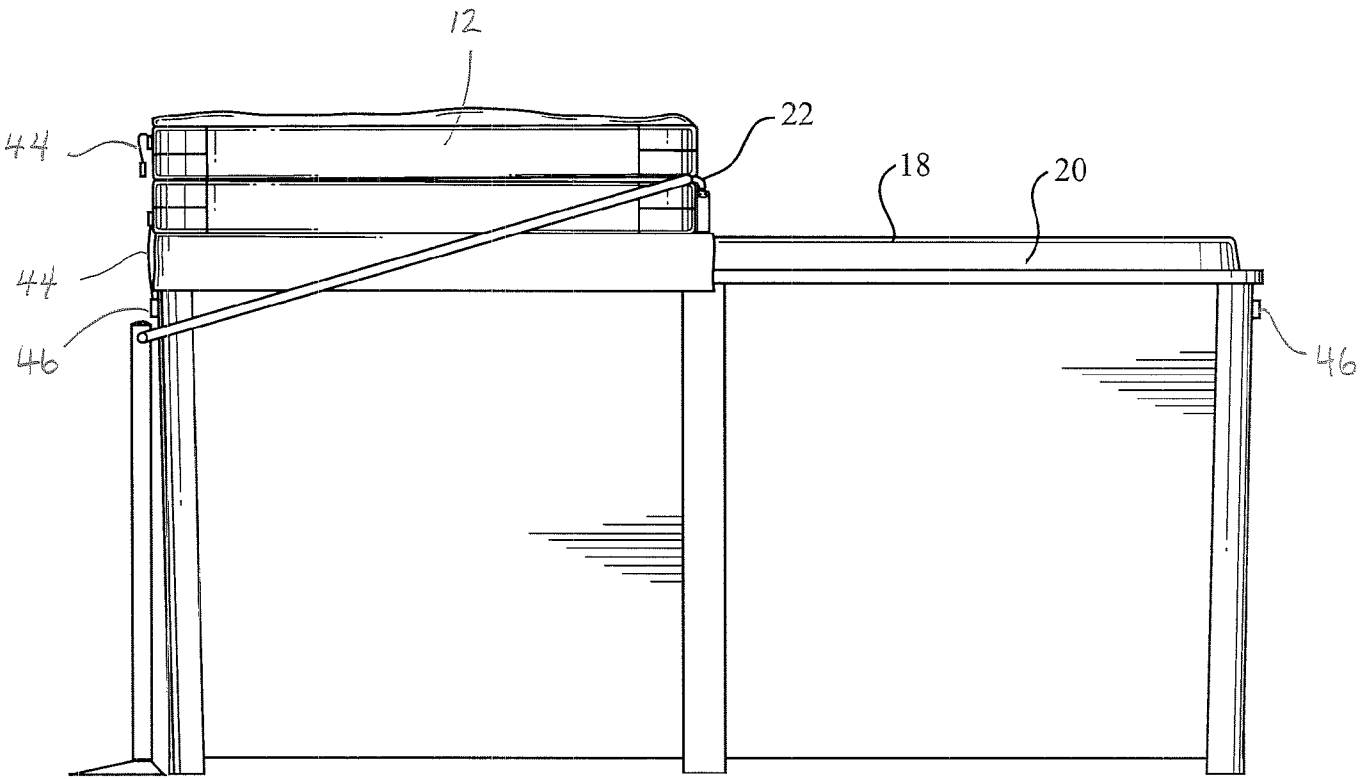
Fig. 2 Prior Art
FIG. 2 is a side view of the spa tub and cover of FIG. 1, in which the cover is in a partially open configuration.
Figure 3:
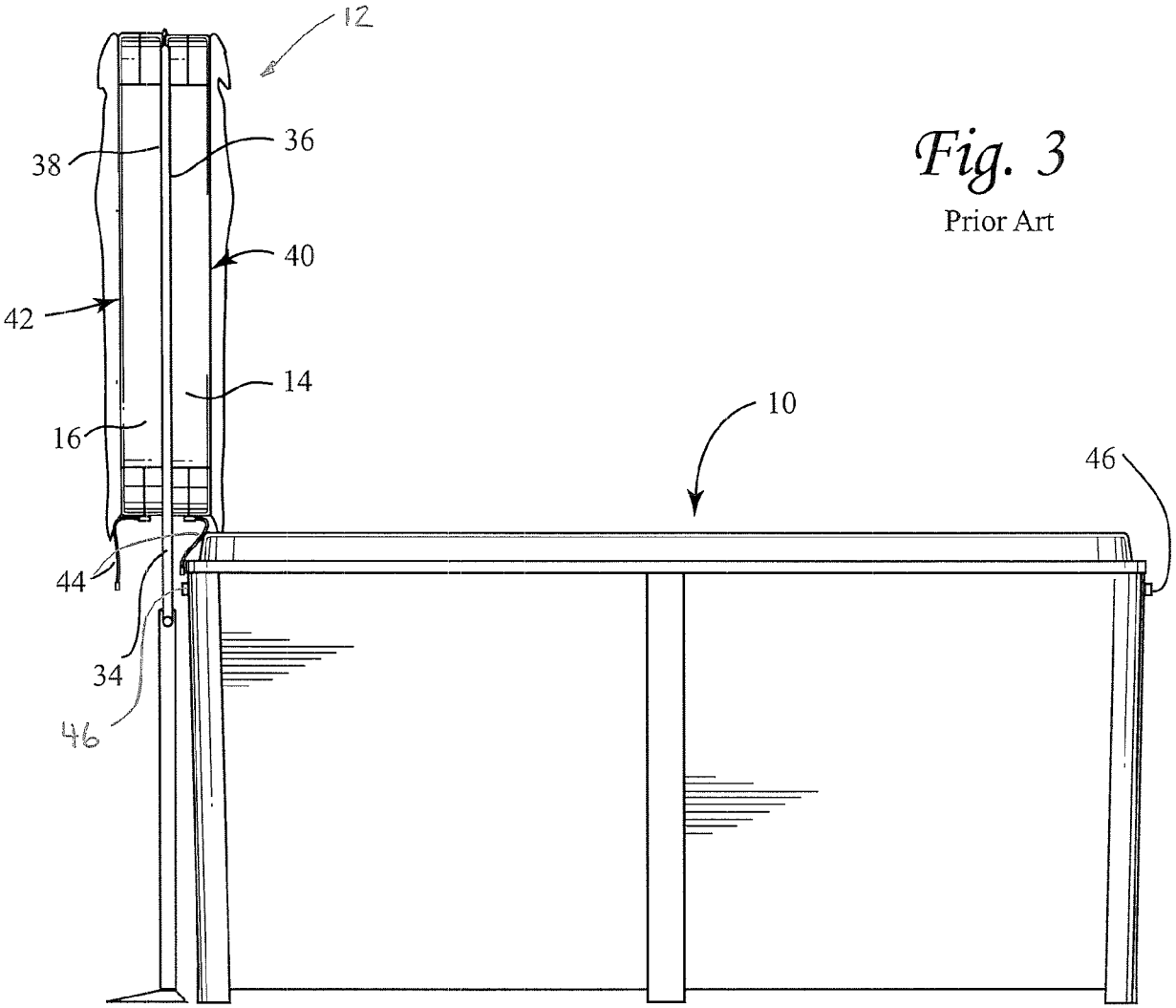
Fig. 3 Prior Art
FIG. 3 is a side view of the spa tub and cover of FIG. 1, in which the cover is in a fully open configuration.
Figure 4:
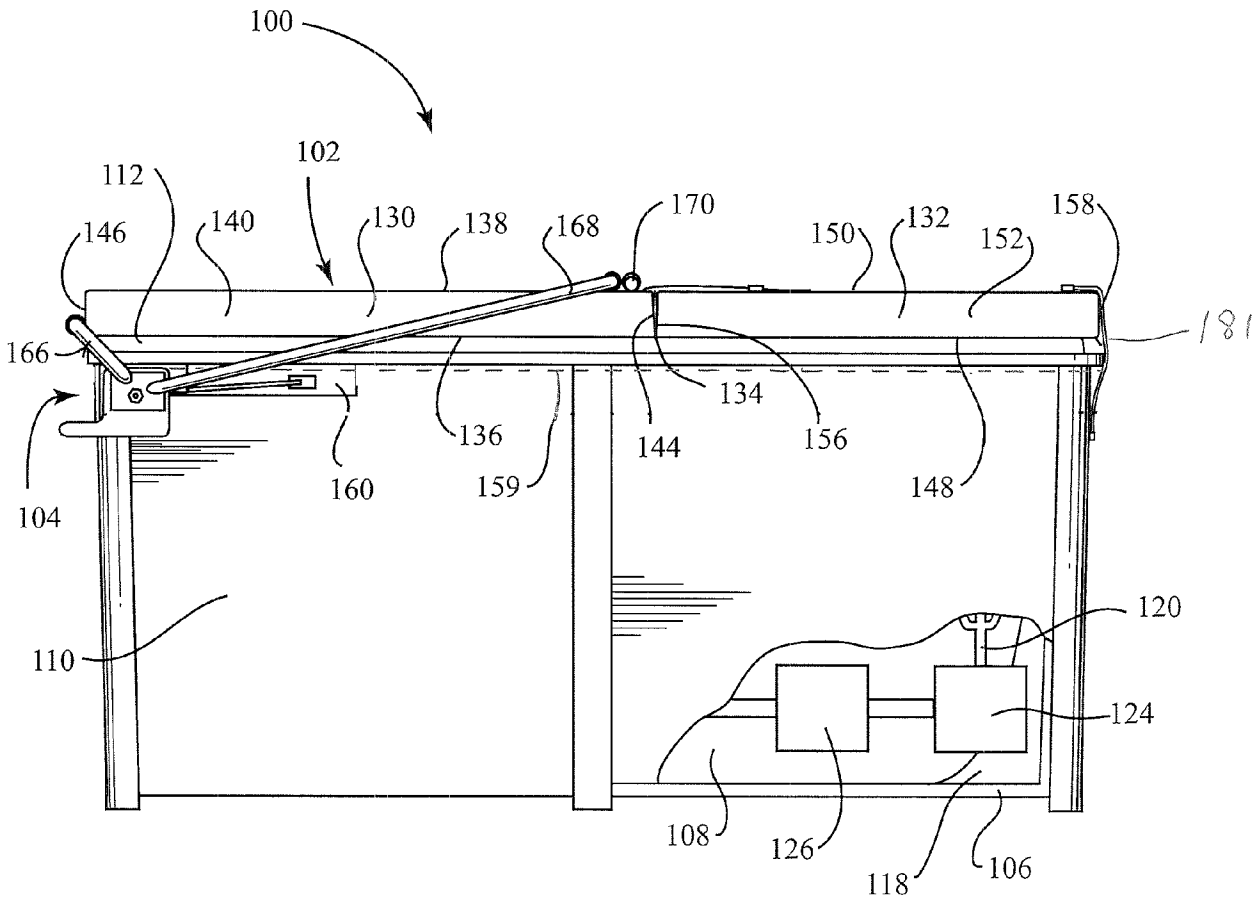
FIG. 4 is a partial side elevation of a spa tub and cover with cover lifter according to the invention.
Figure 5:
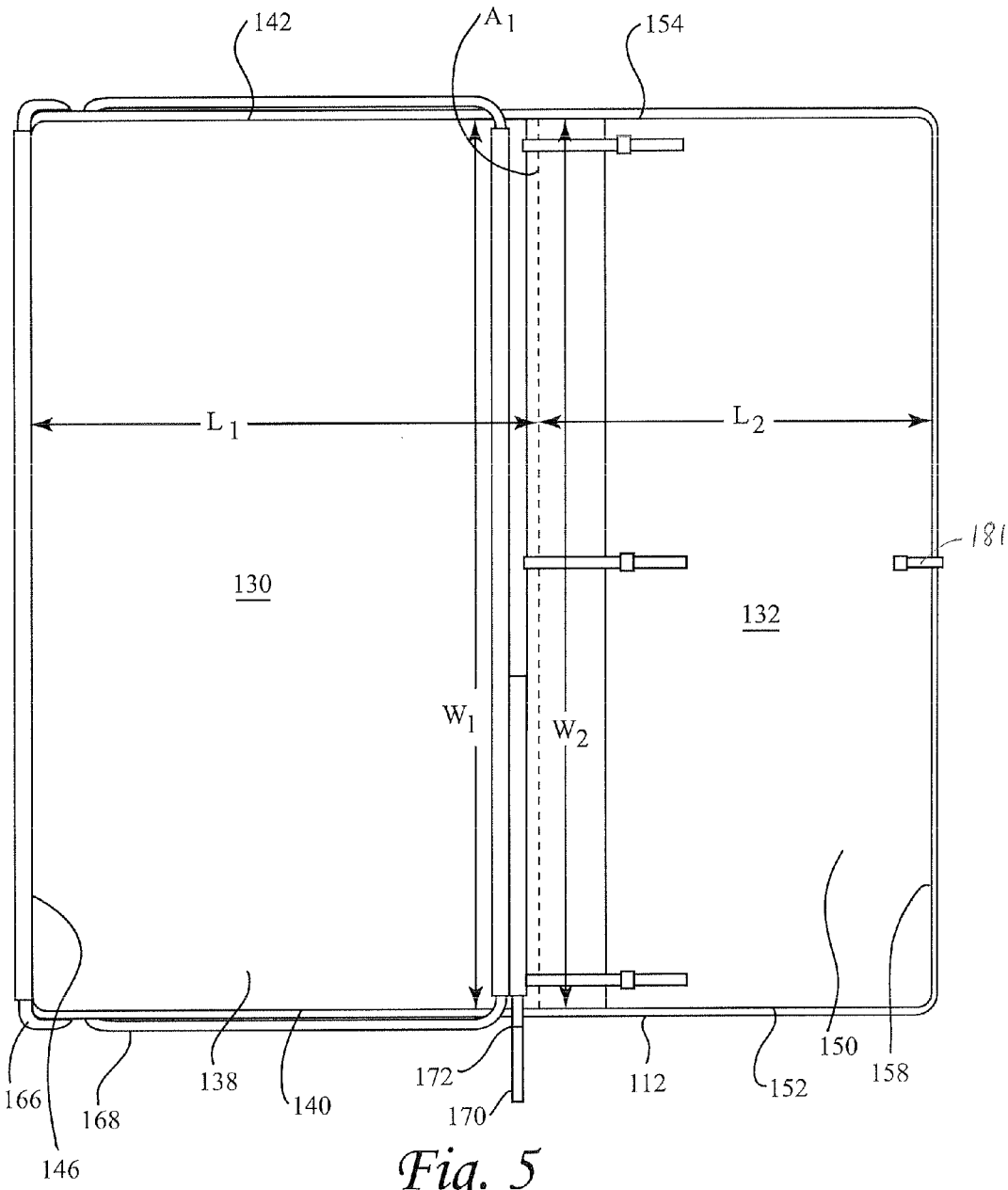
FIG. 5 is a top view of the spa tub cover and lifter of FIG. 4.
Figure 6:
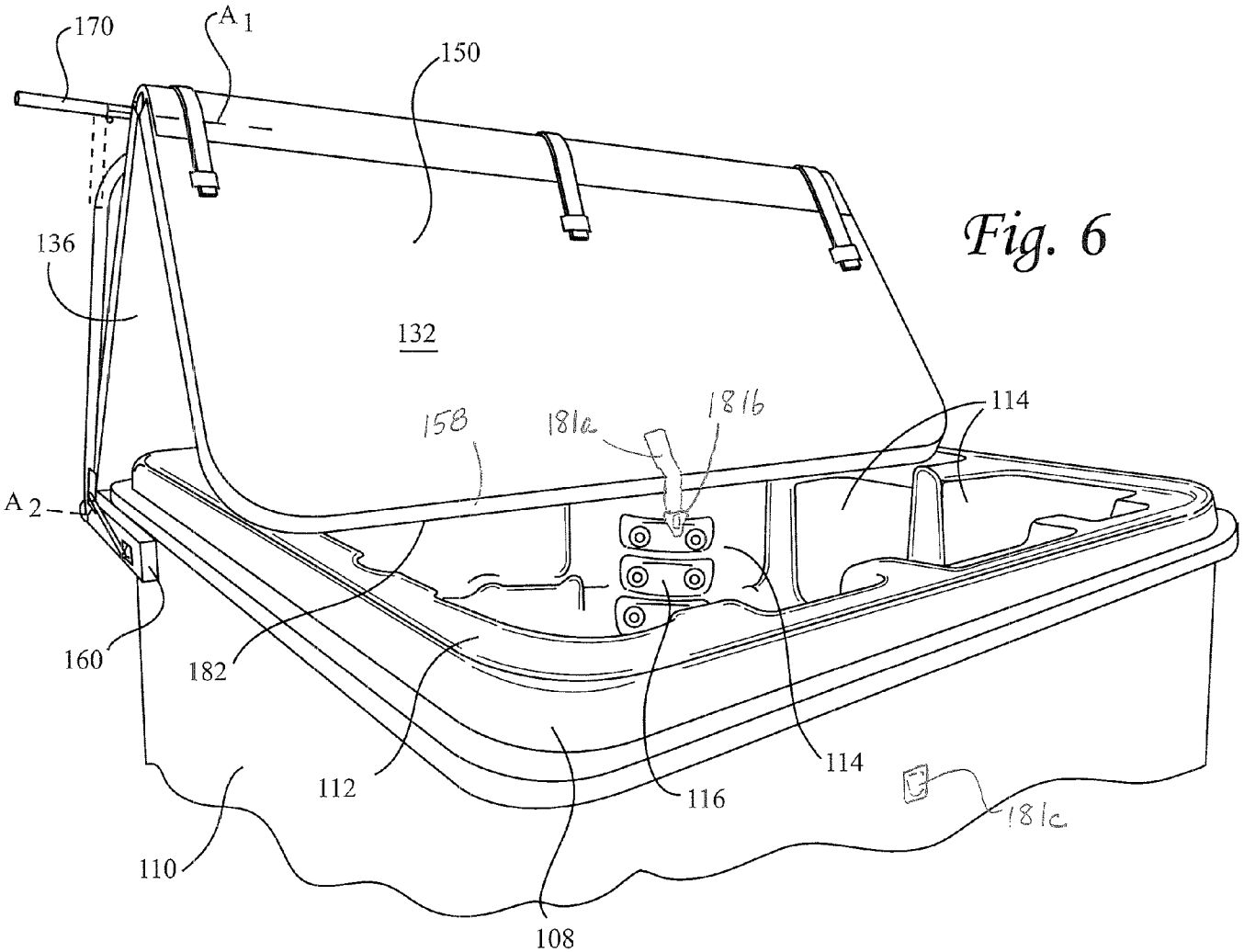
FIG. 6 is a perspective view of the spa tub, cover and lifter, with the cover and lifter shown in a partially open configuration.

Turning now to FIG. 4-6, a portable spa tub 100 is provided with a spa tub cover 102 and a lifter 104 for raising the tub cover relative to the tub so that the tub may be used. The portable spa tub 100 includes a frame 106 that supports a molded tub shell 108, and a cabinet 110 surrounding the frame. The tub shell 108 has an upper boundary rim 112, a plurality of seating locations 114 defined by seat bottoms and backs and reclining lounges, and a lower floor. At one or more of the seating locations 114 hydrotherapy jets 116 are installed and a suction fitting (not shown) is provided near the floor. Between the spa shell 108 and the cabinet 110 a space 118 is defined in which manifolds and other plumbing 120 are provided to connect the jets 116, as well as one or more water pumps 124 that circulate the water, and a heater 126 that heats the water circulated by the water pumps.

The spa cover 102 includes first and second rectangular portions 130, 132 which together are sized to seat on and cover the upper rim 112 of the spa tub shell 108. The first and second portions 130, 132 are coupled together at a hinge 134, as described in more detail below. Each of the first and second portions 130, 132 is constructed of an insulative slab (e.g., a foam slab that has low transmission of heat energy, especially with respect to water heated to a temperature of between 75° and 110°) provided within an at least water-resistant, and more preferably waterproof, casing material such as vinyl.

The first portion 130 of the spa cover has a first lower surface 136 that faces the water in the spa tub 100 and an opposed first upper surface 138. Lateral sides 140, 142 extend between the first lower and first upper surfaces 136, 138. The lateral sides 140, 142 also extend transverse to the first lower surface 136 in a lengthwise dimension. The first portion 130 also includes an inner side 144 extending transverse to both the first lower surface 136 and the lateral sides 140, 142, as well as an outer side 146 extending parallel to and facing opposite the inner side 144. The inner side 144 extends in a widthwise dimension between the lateral sides 140, 142. A first length L1 is defined as the distance between the inner side 144 and the outer side 146. A first width W1 is defined as the distance between lateral sides 140, 142 along the inner side 144.

The second portion 132 of the cover includes corresponding surfaces to the first portion 130, with a second lower surface 148 that faces the tub water and an opposed second upper surface 150. Lateral sides 152, 154 extend between the second lower and upper surfaces 148, 150 in a lengthwise dimension. An inner side 156 extends transverse to the second lower surface 148 in a widthwise dimension between the lateral sides 152, 154. The inner side 156 of the second portion faces the inner side 144 of the first portion. The second portion 132 also includes an outer side 158 extending between the first and second lateral sides 152, 154 and facing opposite the inner side 144 of said first portion. A second length L2 is defined as the distance between the inner side 156 and the outer side 158. A second width W2 is defined as the distance between lateral sides along the inner side 156. In accord with one aspect of the invention, the first and second widths W1, W2 are the same, and the first length L1 is greater than the second length L2. The reasons that length L1 is greater than length L2 is described below.

Figure 7:
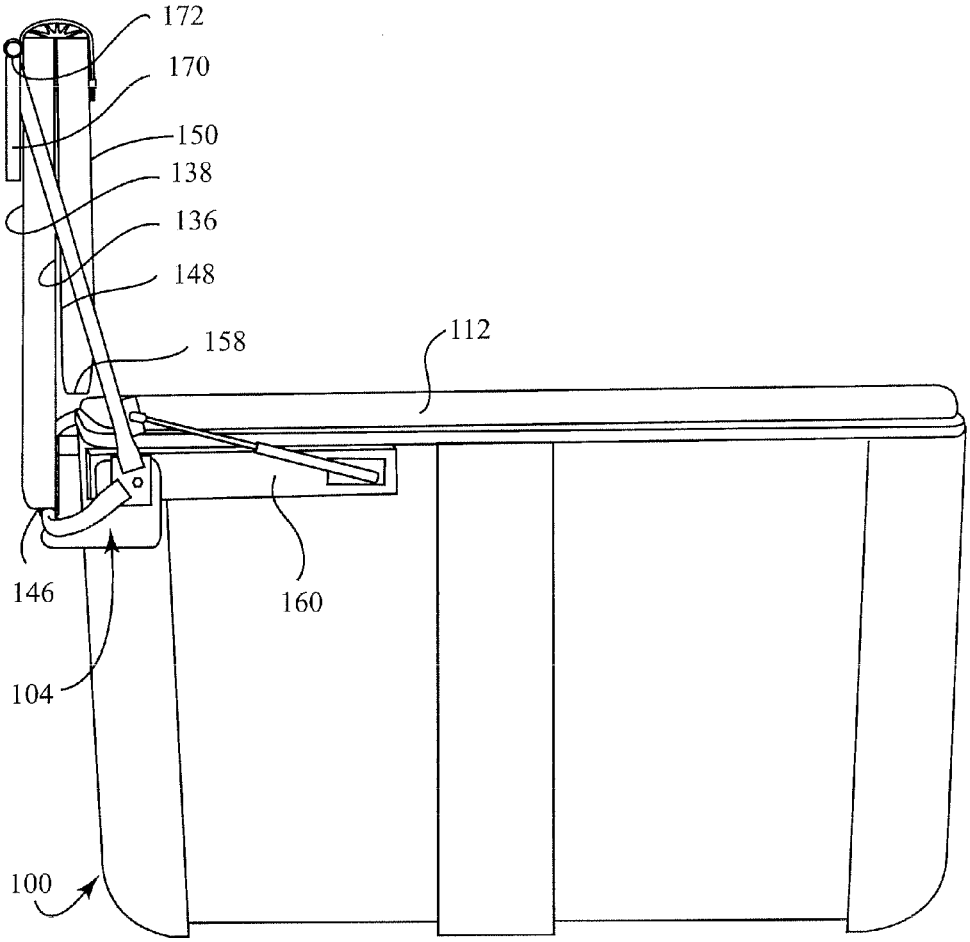
FIG. 7 is a side elevation view of the spa tub, cover and lifter, with the cover and lifter shown in a fully open configuration.
Figure 8:
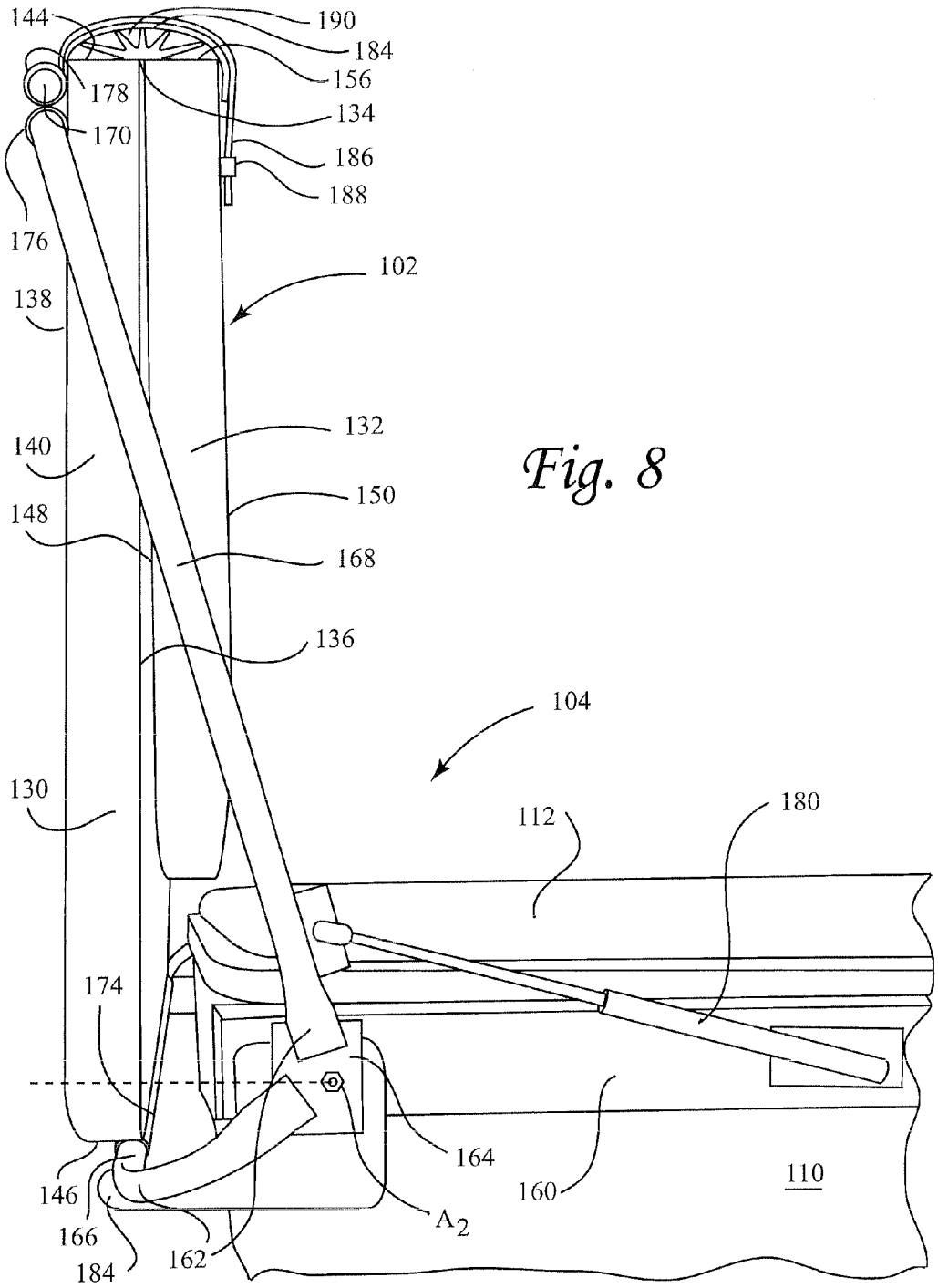
FIG. 8 is an enlarged broken view of a portion of the spa tub, cover and lifter shown in the configuration of FIG. 7.

The hinge 134 that couples the first and second portions 130, 132 has a pivot axis A1 that extends along the first and second portions in a direction parallel to the widthwise dimension defining W1 and W2. The hinge 134 is preferably a living hinge connected to the lower surfaces 136, 148 of the first and second portions. When the cover 102 is in a flat 'closed' configuration, the first and second lower surfaces 136, 148 are co-planar and seat adjacent one another on the upper rim 112 of the spa tub. Because the hinge is preferably provided as a living hinge of the same vinyl material of the first and second portions and because the hinge is provided at the lower surface, an unbroken, gapless seal (preferably air tight) is provided about the entirety of the rim, without the space for heat loss that results from prior art covers. Preferably, a flexible skirt 159 also extends about the perimeters of the first and second lower surfaces to further reduce the opportunity for heat loss and to protect the molded spa tub from the sun when not in use. For purposes of clarity, the skirt 159 is not shown in several of the figures; nevertheless it is preferably present in all embodiments. However, given that the hinge is at the lower surface, the methods of opening and removing a spa cover which are used in the prior art cannot be used with the cover of the invention, and another method is provided as described hereinafter. Referring to FIGS. 7 and 8, when the cover 102 is moved into a folded 'open' configuration, the lower surfaces 136, 148 which face the water when in the closed configuration and can be unsightly, are moved into a position in which they face each other, whereas the upper surface 150 of the second portion faces the users in the tub 100 and opposite upper surface 136. The lengths L1 and L2 are different to allow the spa cover to be folded and raised up; given the manner of folding and raising, if the lengths L1, L2 were equal the second portion 132 would be too long to rotate into a vertical position with the relatively small profile lifter and about a pivot axis located on the spa cabinet. Given that the first and second portions 130, 132 have different lengths L1, L2 (maximum dimension transverse to the hinge pivot axis A1), when the cover 102 is in the open configuration, the first and second outer sides 146, 158 are longitudinally displaced from one another such that they are not coplanar.

The lifter 104 facilitates lifting the cover 102 from the closed configuration (FIGS. 4 and 5) to the open configuration (FIGS. 7 and 8). More particularly, the lifter 104 couples to the first portion 130 of the cover in a fixed relation; i.e., the first portion 130 cannot freely swing or otherwise move relative to the lifter. Referring specifically to FIG. 8, the lifter 104 is coupled to the spa tub with one or more supports 160 that are attached directly to the spa tub 100, such as at the frame and cabinet 110 as shown, or may be self-supporting on the ground (not shown). In the embodiment of the lifter 104 shown in the figures, two supports are provided on opposite sides of the spa tub, but only one support 160 is visible. It is appreciated that the second support is a mirror image of the first support. The second support is optional and a single first support of sufficient structure and stability can be used.

In one embodiment, a lifter frame 162 is coupled to the supports 160 at mounts 164 rotatable about a common pivot axis A2. The lifter frame 162 includes a U-shaped outer member 166 which extends across the outer side 146 of the first portion 130 and to the mounts 164, and a U-shaped upper member 168 that extends along the lateral sides 140, 142 of the first portion at an oblique angle relative to the lower surface 136 and across the upper surface 138 of the first portion in proximity to the inner side 144 (FIG. 4). Alternatively upper member 168 can extend along one of the lateral sides 140 and along none of, or only a small portion of the upper surface 138. The lifter frame 162 also includes a handle member 170 that extends or is extendable laterally outward from the spa tub 100 to facilitate movement thereof and may be integrated with or distinct from the upper member 168. The handle 170 may be connected to or integrated with the upper member 168, fixed in position relative to the upper member 168, or may movable relative to the upper member so that the handle does not protrude relative to the sides of the spa tub 100 when not in use. By way of example, the handle 170 may be coupled to a hinge 172 that permits it to fold relative to the frame (FIGS. 6 and 7) or may telescope into a recessed position.

Referring to FIG. 8, in order to couple the lifter 104 to the first portion 130 of the spa cover 102, one embodiment of the first portion 130 of the cover includes a plurality of sleeves, loops, pockets, ties, hook and loop straps, or other suitable structure at which the lifter can be coupled. For example, a first sleeve 174 is provided at the outer side 146 of the first portion and receives the outer member 166 of the frame, a second sleeve 176 is provided along the upper surface 138 and receives the upper member 168 of the frame, and a third sleeve 178 is provided adjacent the second sleeve 176 and receives the handle 170.

Figure 8A:
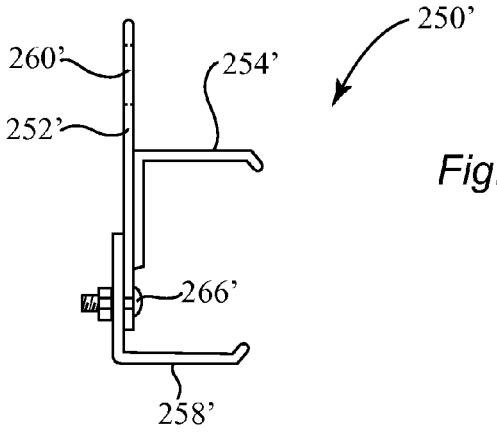
FIG. 8A is an alternative clamping attachment for attaching the lifter to the cover.
Figure 8B:
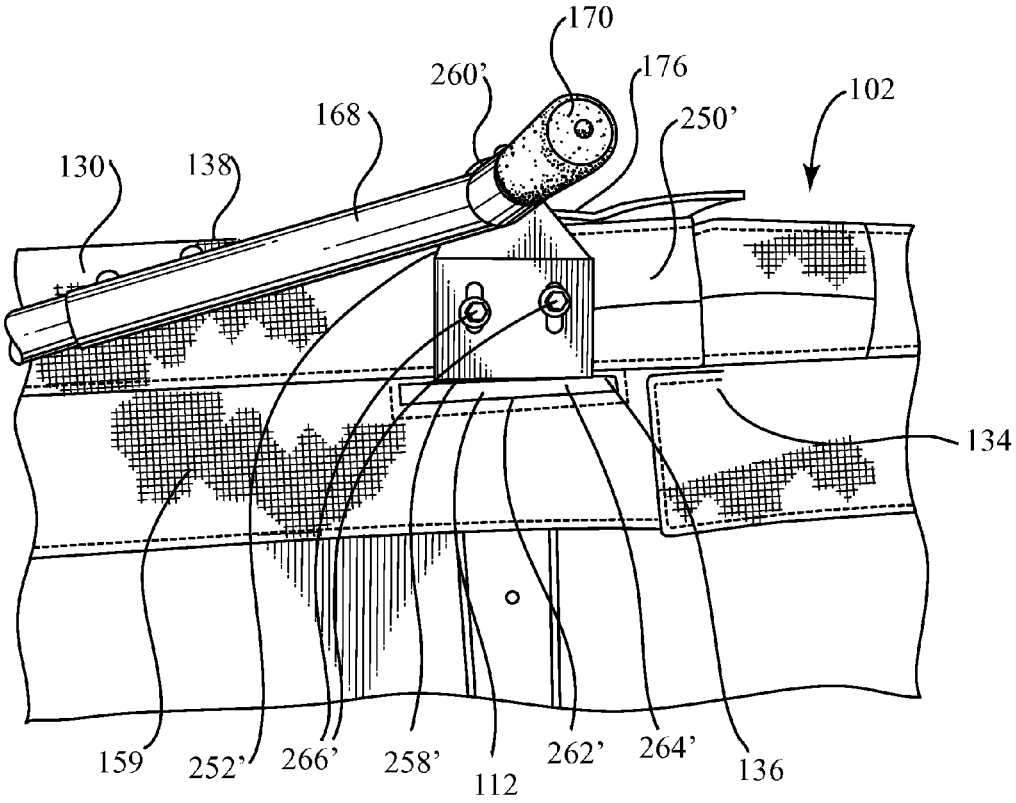
FIG. 8B is a photographic view showing the assembled clamping attachment of the lifter to the cover.

Turning now to FIGS. 8A and 8B, additionally or alternatively, a compression clamp mechanism 250' is provided to securely couple the upper member 168 of the lifter 104 (FIG. 8) to the cover 102. The clamp mechanism 250' includes a vertical bracket 252', a first clamping element 254', and a second clamping element 258' adjustable relative to the first clamping element. The vertical bracket 252' includes a hole 260' through which the handle 170 or a handle carrier extends and is fixed. The first clamping element 254' is fixed relative to the vertical bracket 252' and extends parallel to and adjacent the upper surface 138 and preferably extends within the second sleeve 176 through which a portion of the upper member 168 also extends. The second clamping element 258' extends parallel to the first clamping element and in contact with the lower first surface 136. The cover 102 includes an elongate narrow slot opening 262' within the first portion 130 of the spa cover 100 near the hinge 134 and at the level of the first lower surface 136 and the top of the skirt 159. The slot opening 262' may be reinforced, for example with a sewn border 264'. The second clamping element 258' extends through the slot opening 262', and is adjusted relative to the first clamping element to securely grip the first cover portion 130, and is fixed in position thereabout. This may be accomplished with nut and bolt fasteners 266', springs, or other suitable means. According to a preferred aspect of the embodiment, the second clamping element 258' engages a peripheral portion of the lower surface 136 that is located external the rim 112 of the tub. In this manner, the second clamping element 258' does not interrupt the seal formed between the lower surface 136 and the tub rim 112 when the cover is in a closed configuration.

Referring to FIG. 8, in either embodiment (described with respect to the first embodiment but similarly applicable to both), a pneumatic cylinder 180, piston, spring (e.g., metal or gas), or other form of lift assist, preferably extends between each support 160 and the upper member 168 of the frame to limit the amount of human effort required to lift the cover. In a preferred embodiment, the cylinder stores potential energy in the closed compressed configuration and imparts force through kinetic energy when allowed to expand. The cylinder 180 assists in smoothly rotating the spa cover back and forth between the closed and open configurations. It is preferable that the expansion force of the cylinder be such that when the cover is in the closed configuration, the cylinder enables the cover to be rotated relatively easily about the pivot axis. The lifter assist has a first end rotatably coupled about a pivot axis on the support, and a second end rotatably coupled to the upper member 168. The first end of the lifter assist is always displaced further from the pivot axis A2 than the second end of the lifter assist, as exemplified by the lifter assist shown in each of the flat configuration (FIG. 4), the fully open configuration (FIGS. 7 and 8), and an intermediate configuration (FIG. 6). More particularly, once the seal between the cover 102 and the rim 112 is broken (discussed below), if even a slight manual force is exerted on the cover toward an open configuration (e.g., an angular rotation of 5-25° about the axis A2), the expansion force of the cylinder 180 is sufficient to effect automatic opening from that point forward, even if the handle 170 or the cover 102 is not otherwise subject to additional force by the user. Further, the cylinder assists moving the spa cover from the open configuration into the closed configuration by preventing the cover from rotating too quickly which could otherwise occur, e.g., due to a lack of sufficient user strength to control such smooth closure or slippage of the handle from a user's grip. It is preferable that the cylinder 180 be coupled to the second support member 168 and oriented such that once the cover 102 is rotated even a relatively small angular displacement about axis A2 (e.g., 10°-25°) from the open configuration toward the closed configuration, the cylinder 180 operates as a closure assist, with such closure compressing the cylinder gas and thereby gradually lowering the cover into the closed configuration. Moreover, because the cover is fixed in position relative to the cover at support bars 166, 168 and always referenced relative to the pivot axis A2, in distinction from other covers which can slide around relative to their manually activated lifting mechanisms, the cover is always referenced relative to the spa rim to automatically ensure a complete seal about the rim each time it is moved to the closed configuration.

Further, the cover 102 may be closed on the spa tub from either outside or inside the spa. From outside the spa, the user grabs the handle 170 and pulls the 102 cover toward the closed position. Once the cover 102 is partially closed, the handle 170 can be released, the fixed location of the pivot axis A2 to which the first portion 130 of the cover 102 is fixed, and cylinder 180 ensure that the cover smoothly closes in the same position each and every time. From inside the spa, the user grabs the outer side 158 of the second portion 132 (a handle may be provided for this purpose) and starts pulling and walks the cover closed as the user steps through the tub, away from the lift assist, and out of the spa. The cover will automatically close on its own after a certain amount of angular displacement toward the closed configuration.

Once the spa is in a closed configuration as shown back in FIG. 4, a single locking mechanism 181 extending between the second portion 132 of the cover 102 and the spa cabinet 110 can be used to secure the entirety of the cover 102 relative to the spa tub. The locking mechanism 181 can comprise a strap 181*a* and first mating element 181*b* on the second portion of the cover and a second mating element 181*c* fixed relative to the cabinet 110 and which is engageable with the first mating element 181*b* (as also seen in FIG. 6). The first and second mating elements 181*b*, 181*c* may include snap-locking elements, two elements that together receive a padlock, another locking structure, or a combination of suitable locks. The strap 181*a* and second mating element 181*c* are preferably attached at a location generally corresponding to the middle of width W2 of the second portion, preferably at or near the outer side 158. The single lock mechanism 181 effects lock-down of the entire cover 102 for the following reasons. The outer side 158 of the second portion 132 is locked down relative to the cabinet 110 with lock 181, the seal between the cover 102 and rim 112 inhibits lifting of the cover without lifting the outer side 158 of the second portion 132, and the first portion 130 of the cover is fixed to the support bars 166, 168 of the lift assist system and cannot be lifted when the second portion 132 of the cover is immobilized.

Referring to FIGS. 6 and 8, when the locking mechanism 181 is released and the handle 170 is raised, the lifter is rotated about axis A2. Because a seal is provided between the rim and cover, in order to lift the cover, it may be necessary to first break the seal at some location about the periphery of the cover. This can be done by applying an upward force with a user's hand, e.g., at the outer side 158 of the second portion 132 or at the handle 170. Once the seal is broken, a slight additional lifting force allows the cylinder 180 to assist in rotating the first portion 130 and consequently the second portion 132 into the open configuration. Further, the cylinder can be configured to substantially apply all the force to open the cover once the seal is broken. More particularly, when moving toward the open configuration, the second portion 132 is caused to rotate about hinge axis A1 toward the open configuration. Given that the hinge axis is defined by flexible material, the meaning of 'hinge axis' includes a perfectly straight axis as well as the natural 'slop' that may occur with such a flexible hinge. The second portion 132 may be entirely lifted from the spa rim 112 during such rotation or the corner 182 (defined at the intersection of the lower surface 148 and the outer side 158) may be drawn across and in contact with the rim 112. As the lifter rotates, the weight of the spa cover is preferably transferred to the outer member 166 which at least partially supports the weight of the first and second portions 130, 132. Once the lifter 104 is fully rotated about axis A2, e.g., through approximately 90° of rotation, the second portion 132 is raised off the rim 112 and in an upright vertical configuration (i.e., oriented transverse to the rim 112). A stop 184, either integrated with the support 160 or distinct therefrom, limits the range of rotation of the lifter and assists in supporting the weight of the lifted cover. Traditional spa covers may be inadvertently closed on a user, particularly on windy days. The stop 184 is situated to support the cover with the weight shifted back and lift-assist cylinder 180 configured to prevent inadvertent closure.

In accord with a preferred aspect of the invention, when in the open configuration the first portion 130 is situated with its outer side 146 below the surface of the rim 112 of the tub and is situated vertically below the pivot axis A2, while the second portion 132 is preferably situated with its outer side 158 vertically even with or above the rim. As stated above, in this open configuration, the lower surfaces 136, 148 face one another, and the upper surfaces 138, 150 face opposite one another. The upper surface 150 of the second portion is oriented in a substantially vertical plane and faces toward the spa tub 100.

A debris shield 184 is provided over the hinge 134 to protect the hinge from acquiring environmental detritus, such as leaves, cut grass, insects, etc., particularly when the cover 102 is in the open configuration and the inner sides 144, 156 of the first and second portions are rotated apart. That is, because the hinge 134 is located along the lower surfaces 136, 148, the cover at the hinge is open at top. The debris shield 184 is a preferably flexible panel that extends over the cover 102 at the hinge 134 and is preferably fixed with respect to one of the first and second portions 130, 132, and preferably movable relative to the other of the first and second portions 132, 130. In a preferred embodiment, the debris shield 184 is fixed to the upper surface 138 of the first portion 130, preferably proximate the hinge 134 opening, and extends across the hinge opening to rest on the upper surface 150 of the second portion 132. The shield 184 may be fixed to the first portion 130 by sewing, adhesive bonding or any other suitable means. The shield 184 may be movably retained along the upper surface 150 of the second portion 132. For example, receiving straps 186 extending from the panel may slidably move within strap loops 188 along the upper surface of the second portion. In the closed configuration, the straps 186 can extend more completely through the loops 188, whereas as the cover is moved toward the open configuration, the straps 186 are drawn through the loops 188, preferably without becoming free thereof, to permit the hinge to open. Alternatively, the debris shield 184 may be fixed to both the first and second portions 130, 132, and constructed of an elastic and/or resilient material that permits the shield to stretch as the cover is moved into the open configuration. The debris shield 184 may further include a bias member 190 that biases the shield into a convex configuration when the cover is in the open configuration so that shield does not fall between the first and second cover portions 130, 132 and to present a surface that deflects debris. The bias member 190 may include a plicated structure that folds flat as the spa cover is moved into a closed configuration, but which expands and bows outward as the cover is moved into the open configuration. Alternative or additional bias members may be used.

Figure 9:
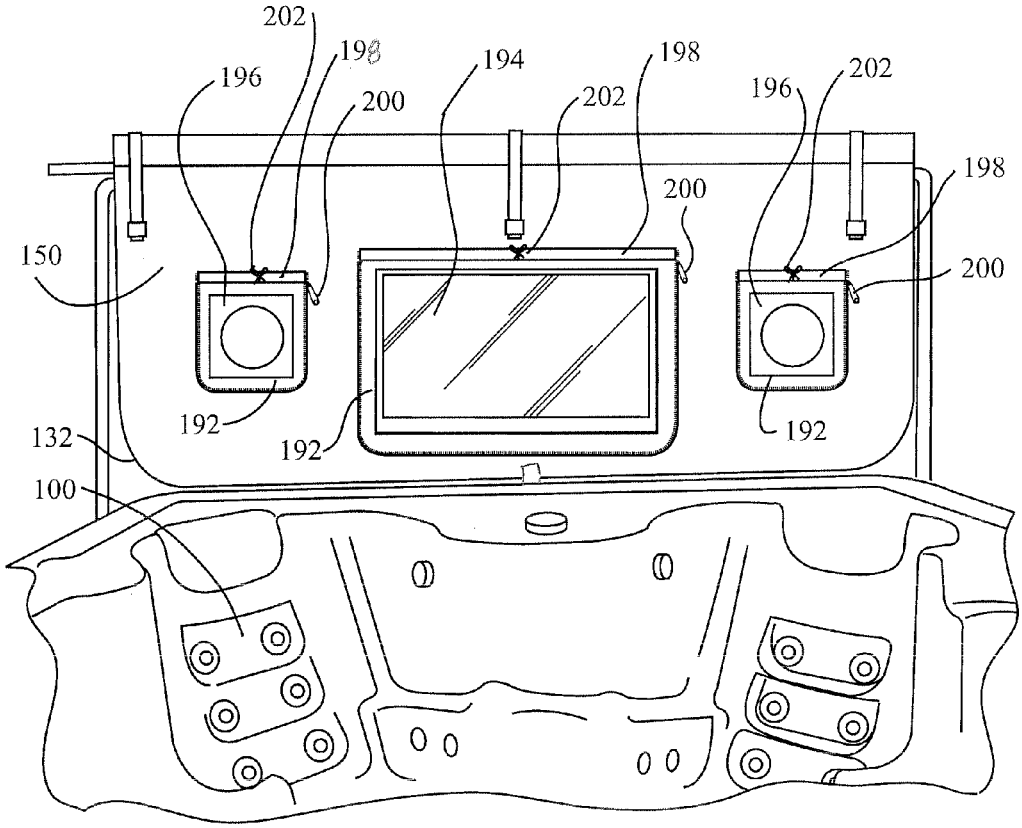
FIG. 9 is a broken end view of the spa tub, cover and lifter shown in the open configuration, with optional audio and video components installed in the cover.

Turning now to FIG. 9, as discussed above, when the spa tub cover 102 is in the open configuration, the upper surface 150 of the second portion 132 faces the users of the spa tub 100. According to another preferred aspect of the invention, at least one audio and/or video device is at least partially disposed within one or more openings 192 in the upper surface of the second portion. Such a device can include a video monitor 194, which may include a television tuner or inputs for receiving a signal from any suitable source such as a computer, as well as speakers 196, an amplifier, etc. The upper surface 150 of the second portion 132 is preferably provided with flaps 198 or other structure that cover the video monitor and speakers when not in use. Such flaps 198 may be retained closed with a zipper 200, hook and loop fasteners or any other suitable means so that environmental debris does not effect the devices, particularly when the cover is closed and the spa tub is not in use. In addition, retaining ties 202 may be provided to hold the flaps 198 open so that they do not obstruct the audio and/or video devices during use.

Figure 10:
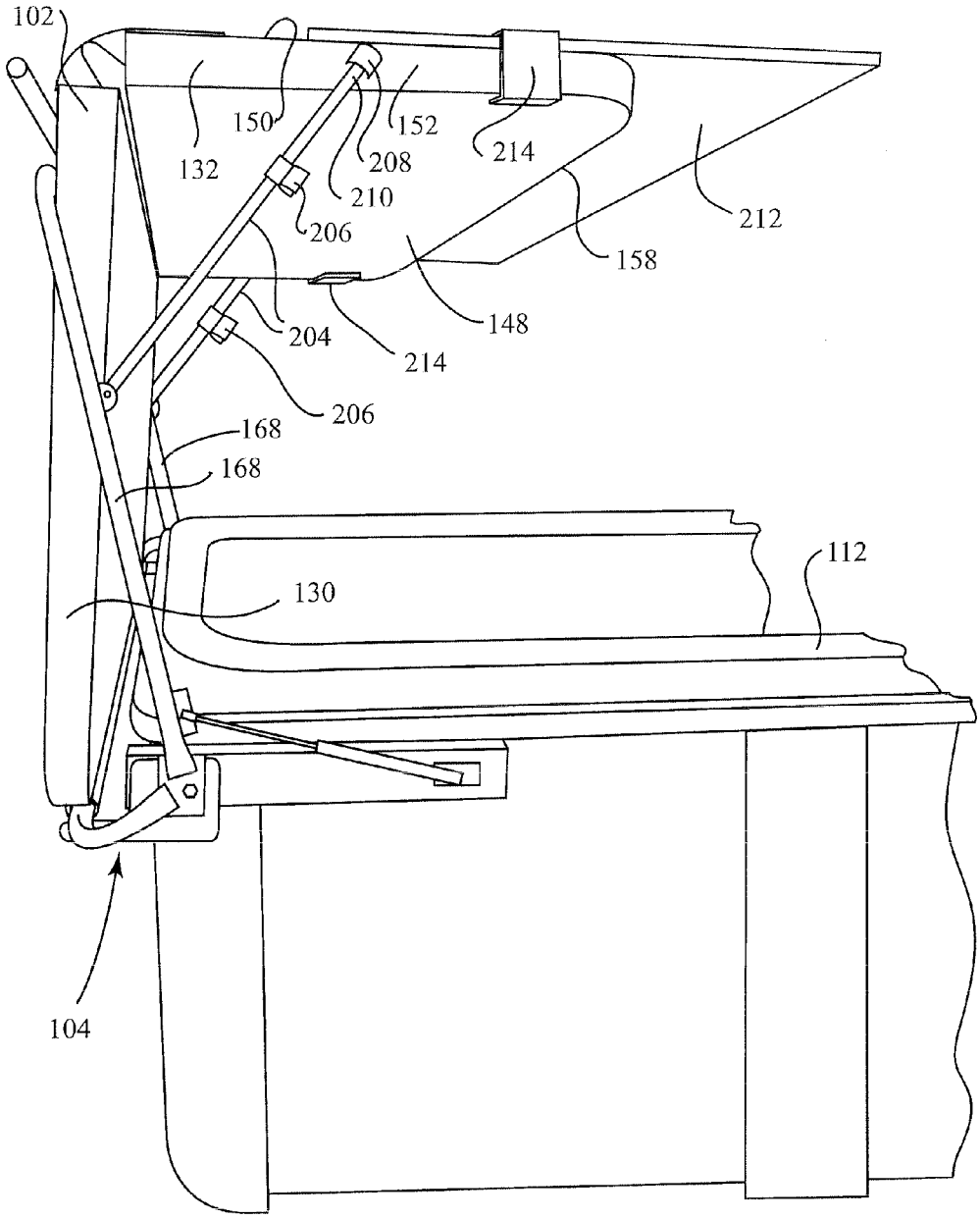
FIG. 10 is a broken side elevation of the spa tub, cover and lifter shown in a configuration in which a portion of the cover is oriented to provide shade.

Referring to FIG. 10, according to yet another preferred aspect of the invention, given the manner in which the cover 102 moves toward an open configuration, the cover lifter 104 can be configured to orient the first portion 130 of the cover transverse to the upper rim 112 of the spa tub, and suspend the second portion 132 of the cover over the spa tub; i.e., the second lower surface 148 is preferably substantially parallel to (within ±20°), but vertically displaced from the upper rim 112. Additional frame members, such as struts 204, may be provided to temporarily lock the frame with first and second portions in this position. Struts may be pivotally mounted to upper member 168 and may each be provided with a latch 206 that couples the strut to the upper member when not in use. The second portion 132 of the cover can include flexible pockets or rigid brackets 208 at the lateral sides 152, 154 in which the free ends 210 of the struts 204 may be received to couple the struts to the second portion of the cover. This allows the second portion 132 of the spa cover, extending and retained over a portion of the spa tub and the users therein, to function as a sun shade. Further, a supplemental shade 212 may be integrated into or coupled to the second portion of the cover such that it may extend therefrom to provide additional shade over the spa tub and the users. Such supplemental shade 212 may be attached to the second portion with releasable brackets 214, may be slidable along the upper surface 150 of the second portion 132, or may be foldable outward, telescope outward, or drawn and retained outward relative to the outer side 158 of the second portion.

Figure 11:
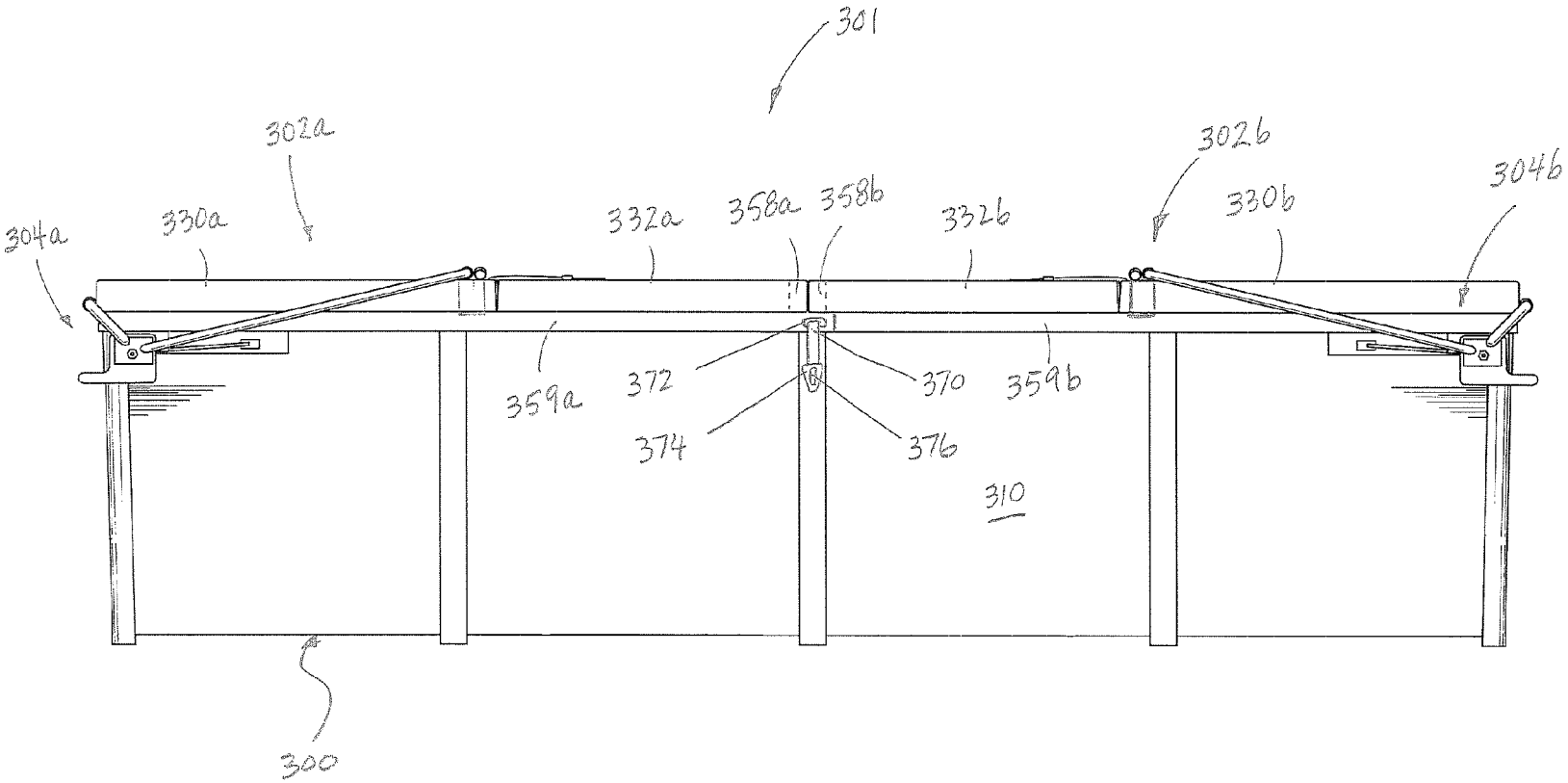
FIG. 11 is a side elevation of another embodiment of a spa tub, cover and lifter shown in a closed configuration.
Figure 12:
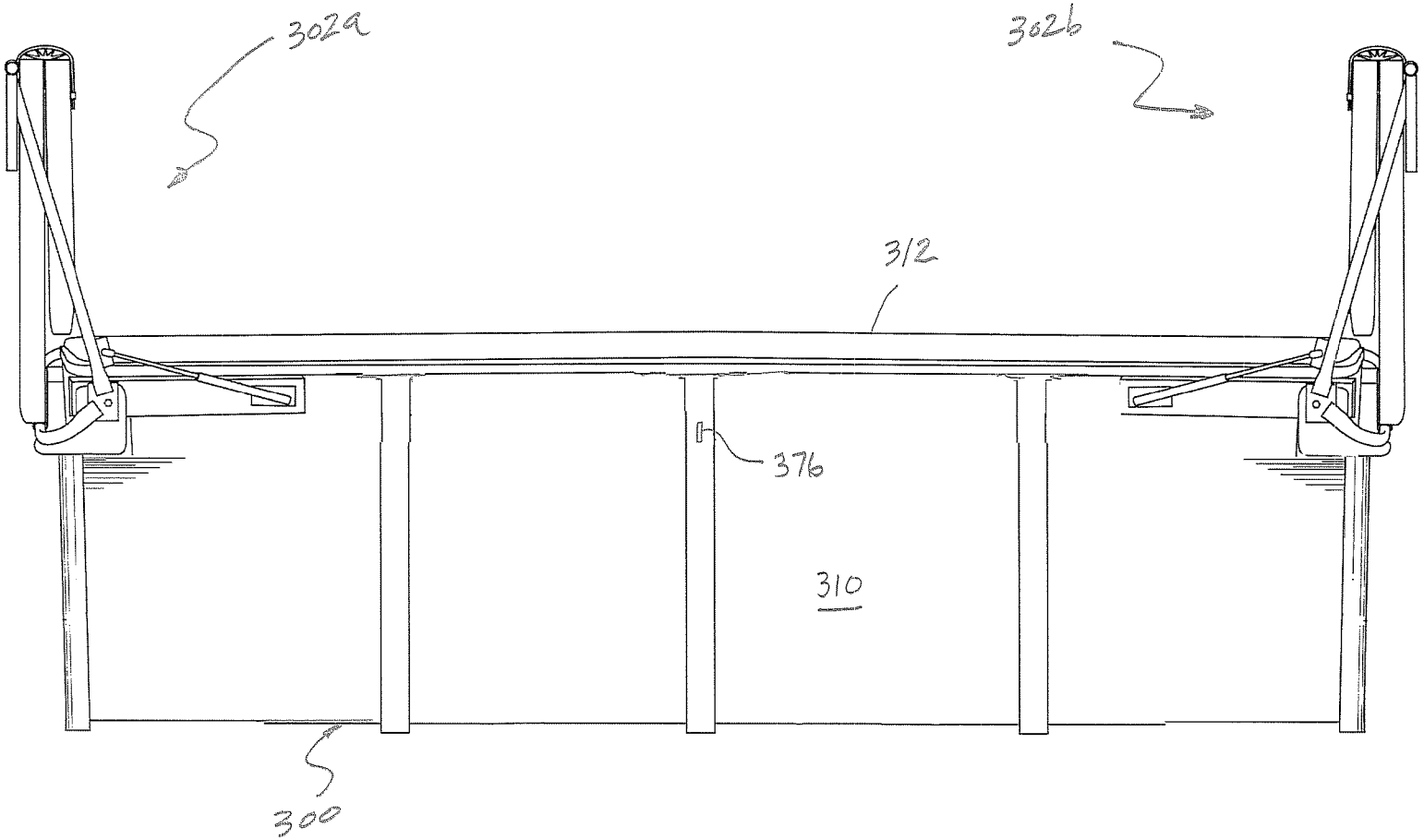
FIG. 12 is a side elevation of the embodiment of FIG. 11 shown in an open configuration.

Turning now to FIGS. 11 and 12, another embodiment of a cover system and cover lifter system is shown with respect to a larger, elongate spa 300, such as of the type commonly referred to in the art as a 'swim spa'. Such cover system 301 includes a first cover 302*a* having a first portion 330*a* and a second portion 332*a*, generally as described above, and a second cover 302*b* having a first portion 330*b* and a second portion 332*b*. Each cover 302*a*, 302*b* has its own associated lifter 304*a*, 304*b* situated at and preferably mounted to, opposite ends of the spa tub. The first and second covers 302*a*, 302*b* are oriented in a left-right mirror orientation so that the respective second portions 332*a*, 332*b* meet along the rim 318 at the middle of the spa tub. In the prior embodiment, the lifter always references the position of the cover relative to the spa. In this embodiment, the lifters 304*a*, 304*b* reference the positions of both covers 302*a*, 304*b* relative to the spa. When the lifters 304*a*, 304*b* are operated to move the first and second covers 302*a*, 302*b* into a closed configuration, the ends 358*a*, 358*b* of the second portions 332*a*, 332*b* of the first and second covers are referenced to always contact each other with a degree of force sufficient to form a seal. In order to facilitate closure with a seal, the second portions 332*a*, 332*b* of the covers at and adjacent the ends 358*a*, 358*b* are formed of a softer more compressible material than the remainder of the insulative cover materials. The softer compressible material causes the two meeting ends 358*a*, 358*b* to compress when contacted against the other in the closed configuration; this ensures continuity of seal across the spa tub between the first and second covers 302*a*, 302*b* and about the entire periphery of the spa tub at the rim 312 of the tub 300.

Furthermore, a single lock mechanism is provided that can lock down the entire cover system; i.e., both covers 302*a*, 302*b*, to prevent unintended usage of the spa. In one embodiment the lock mechanism includes a strap 370 that is fixed to a portion of the skirt portion 359*b* on the second portion 332*b* of the second cover 302*b*, a slot opening 372 in the skirt portion 359*a* on the second portion 332*a* of the first cover 302*a* through which the strap 370 can be inserted and removed, a locking element 374 at the end of the strap and a mating element 376 coupled to the cabinet 310 of the spa at which the locking element 374 can be coupled, either with or without additional locking structure. Alternatively, separate straps and locking element can extend from each of the second portions 332*a*, 332*b* of the covers, each strap provided with its own locking element and locked at a common point on the cabinet. As yet another alternative, the locking elements may be coupled at separate and/or distinct but preferably adjacent mating elements on the cabinet. In each locking system, it is possible to relatively easily lock and unlock the entire cover system from one side of the spa tub, and preferably from a centralized location along the cabinet side wall.

There have been described and illustrated herein several embodiments of a spa cover, a lifter in association of the spa cover, and a spa provided with the cover and lifter. In addition, methods of folding the spa cover are also provided. While particular embodiments of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its spirit and scope as claimed.

What is claimed is:

1. A spa tub cover and lifter system for use in association with a spa tub, the spa tub having a tub shell defining an interior for holding water and an exterior, said tub shell having a plurality of seating locations and an upper rim having a perimeter, the perimeter having a first dimension and a transverse second dimension, said spa tub cover and lifter system comprising:

a) a spa tub cover including, i) a first spa cover portion including a heat insulative material surrounded by an at least water resistant covering, said first spa cover portion having a first lower surface that faces the interior of the tub shell of the spa tub and an opposed first upper surface, first and second lateral sides extending transverse to said first lower surface in a lengthwise dimension, an inner side extending transverse to said first lower surface and said lateral sides in a widthwise dimension between said first and second lateral sides, and an outer side extending in said widthwise dimension between said first and second lateral sides and facing opposite said inner side, wherein a first length is defined as the distance between the inner and outer sides of said first spa cover portion, and a first width is defined as the distance between the lateral sides along the inner side of the first spa cover portion, ii) a second spa cover portion coupled to said first spa cover portion, said second spa cover portion including a heat insulative material surrounded by an at least water resistant covering, said second spa cover portion having a second lower surface that faces the interior of the spa shell of the spa tub and an opposed second upper surface, first and second lateral sides extending transverse to said second lower surface in a lengthwise dimension to define a second length, an inner side extending transverse to said second lower surface in a widthwise dimension between said first and second lateral sides to define a second width, and an outer side extending in said widthwise dimension between said first and second lateral sides and facing opposite said inner side of said first spa cover portion, wherein a second length is defined as the distance between the inner and outer sides of said second spa cover portion, and a second width is defined as the distance between said lateral sides along said inner side of said second spa cover portion, wherein said first and second widths are the same, and said first length is greater than said second length, said first and second spa cover portions rotatable relative to each other on a hinge about a hinge axis extending parallel to said widthwise dimension between a flat configuration and a folded configuration, said hinge connecting said first and second lower surfaces, and when in said flat configuration, said first and second lower surfaces are co-planar, and said first and second inner sides face on another, and when in said folded configuration, said first and second lower surfaces face one another and said first and second upper surfaces face away from one another; and b) a lifter system including, i) a support located relative to the spa tub, ii) a mount rotatably coupled to said support and defining a pivot axis, iii) at least one frame member coupled to said mount and rotatable about said pivot axis, and iv) a clamp coupled to said at least one frame member, said clamp clamping about said first upper surface and said first lower surface of said first spa cover portion, wherein when said first and second spa cover portions are in said flat configuration and said at least one frame member is then rotated about said pivot axis, said clamp applies a lifting force to said first spa cover portion.

2. A spa tub cover and lifter system according to claim 1, wherein:

in said flat configuration, a seal is formed between the first and second lower surfaces and said hinge and the rim of the spa tub shell.

3. A spa tub cover and lifter system according to claim 1, wherein:

said cover includes a flexible peripheral skirt extending below said first and second lower surfaces, said skirt includes a slot, said cover clamp includes first and second clamping elements, and one of said clamping elements extends through said slot of said skirt.

4. A spa tub cover and lifter system according to claim 2, further comprising:

a lifter assist, wherein once a user breaks the seal said lifter assist automatically lifts said spa tub cover from rim and thereby rotates said second cover portion relative to first cover portion into said folded configuration.

5. A spa tub cover and lifter system for use in association with a spa tub, the spa tub having a tub shell defining an interior for holding water and an exterior, said tub shell having a plurality of seating locations and an upper rim having a perimeter, the perimeter having a first dimension and a transverse second dimension, said spa tub cover and lifter system comprising:

a) a spa tub cover including, i) a first spa cover portion including a heat insulative material surrounded by an at least water resistant covering, said first spa cover portion having a first lower surface that faces the interior of the tub shell and an opposed first upper surface, first and second lateral sides extending transverse to said first lower surface in a lengthwise dimension, an inner side extending transverse to said first lower surface and said lateral sides in a widthwise dimension between said first and second lateral sides, and an outer side extending in said widthwise dimension between said first and second lateral sides and facing opposite said inner side, wherein a first length is defined as the distance between the inner and outer sides of said first spa cover portion, and a first width is defined as the distance between the lateral sides along the inner side of the first spa cover portion, ii) a second spa cover portion coupled to said first spa cover portion, said second spa cover portion including a heat insulative material surrounded by an at least water resistant covering, said second spa cover portion having a second lower surface that faces the interior of the tub shell and an opposed second upper surface, first and second lateral sides extending transverse to said second lower surface in a lengthwise dimension to define a second length, an inner side extending transverse to said second lower surface in a widthwise dimension between said first and second lateral sides to define a second width, and an outer side extending in said widthwise dimension between said first and second lateral sides and facing opposite said inner side of said first spa cover portion, wherein a second length is defined as the distance between the inner and outer sides of said second spa cover portion, and a second width is defined as the distance between said lateral sides along said inner side of said second spa cover portion, wherein said first and second widths are the same, and said first length is greater than said second length, said first and second spa cover portions rotatable relative to each other about a hinge that connects the lower surfaces of the first and second spa cover portions, said hinge defining an axis that extends parallel to said widthwise dimension between a flat configuration and a folded configuration, and when in said flat configuration, said first and second lower surfaces are co-planar and said first and second inner sides face on another, and when in said folded configuration, said first and second lower surfaces face one another and said first and second upper surfaces face away from one another; and b) a lifter system including, i) a support positionable in a stable location relative to the spa tub, ii) a mount rotatable on said support and defining pivot axis, iii) a first support extending from said mount, alongside said first lateral side of said first spa cover portion, and attached to said first upper surface of said first spa cover portion, and iv) a second support extending from said mount, extending along side said outer side of said first spa cover portion, and attached to said outer side of said first spa cover portion, wherein when said first support is rotated on said mount, said second spa cover portion is automatically rotated about said axis from said flat configuration into said folded configuration.

6. A spa cover and lifter system according to claim 5, wherein:

in said folded configuration, said outer side of said second spa cover portion is located higher than said outer side of said first spa cover portion.

7. A spa cover and lifter system according to claim 5, wherein:

in said folded configuration, said outer surface of said first spa cover portion is situated below said pivot axis.

8. A spa cover and lifter system according to claim 5, wherein:

said second support is provided with structure to contact said first outer surface.

9. A spa cover and lifter system according to claim 5, wherein:

said structure is connected to said first outer side at a sleeve on said first outer surface.

10. A spa tub cover and lifter system for use in association with a spa tub, the spa tub having a tub shell defining an interior for holding water and an exterior, said tub shell having a plurality of seating locations and an upper rim having a perimeter, the perimeter having a first dimension and a transverse second dimension, said spa tub cover and lifter system comprising:

a) a spa tub cover including, i) a first spa cover portion including a heat insulative material surrounded by an at least water resistant covering, said first spa cover portion having a first lower surface that faces the interior of the tub shell of the spa tub and an opposed first upper surface, a first inner side extending transverse to said first upper and lower surfaces, a first outer side extending parallel to said first inner side at an opposite end of said first lower surface from said first inner side, a first width, and a first length transverse to said first width, ii) a second spa cover portion including a heat insulative material surrounded by an at least water resistant covering, said second spa cover portion having a second lower surface that faces the interior of the tub shell of the spa tub and an opposed second upper surface, a second inner side extending transverse to said second upper and lower surfaces, a second outer side extending parallel to said second inner side at an opposite end of said second lower surface from said second inner side, a second width, and a second length transverse to said second width, said first length of said first spa cover portion longer than said second length of said second spa cover portion, and said first inner side of said first spa cover portion facing said second inner side of said second spa cover portion, and iii) a flexible hinge about which said first and second spa cover portions are movably connected to each other, wherein said first and second widths are the same and each sufficient to extend across the first dimension of the upper surface of the spa shell, and said first and second lengths together have a combined dimension sufficient to extend across the second dimension of the upper rim of the tub shell when said first and second lower surfaces are seated adjacent one another on said upper rim; and b) a lifter that rotates said first spa cover portion about a single pivot axis having a fixed location, said first spa cover portion held in a fixed relation relative to said lifter, wherein when said lifter is in a first position relative to the spa tub, said first spa cover portion is held in a closed configuration against the upper rim at a first location, when said lifter is in a second position, said first spa cover portion is in a raised open configuration oriented at an angle relative to the upper rim with said first outer side of said first spa cover portion situated below said pivot axis and said second outer side of said second spa cover portion is located higher than said first outer side of said first spa cover portion, and when said lifter is returned to said first position, said lifter automatically returns said first spa cover portion to said first location.

11. A spa tub cover and lifter system according to claim 10, wherein:

said lifter system further includes a lifter assist that reduces an amount of user-supplied force required to rotate said first support between said first and second positions.

12. A spa tub cover and lifter system according to claim 11, wherein:

when said lifter is in said first position, said first and second lower surfaces and said hinge co-extend with each other along the rim of the spa tub shell.

13. A spa tub cover and lifter system according to claim 10, wherein:

when said lifter support is in said first position, a seal is formed between said lower surfaces and said hinge, and the rim of the spa tub.

14. A spa tub cover and lifter system according to claim 13, wherein:

when said lifter is in said first position, said first and second lower surfaces and said hinge co-extend with each other along the rim of the spa tub shell, and a seal is formed between the first and second lower surface and said hinge and the rim of the spa tub shell, and wherein once a user breaks said seal, said lifter assist automatically rotates said lifter into said second position.

15. A spa tub cover and lifter system according to claim 1, wherein:

said clamp clamps without extending between said first lower surface of said first cover portion and the rim of spa tub.

16. A spa tub cover and lifter system according to claim 1, wherein:

said at least one frame member includes a first frame member adjacent and parallel to said outer side of said first spa cover portion and a second frame member extending along side said first lateral side to said first upper surface at a location near said hinge.

17. A spa tub cover and lifter system according to claim 1, further comprising:

a compressed cylinder lifter assist that facilitates rotating said at least one frame member with said spa cover attached thereto on said mount, said lifter assist having a first end and a second end, wherein said at least one frame member includes a frame member extending along side said first lateral side from said mount to said first upper surface at a location near said hinge, said first end of said lifter assist coupled about a second pivot axis on said support, and said second end of said lifter assist coupled to said frame member, said lifter assist rotates about said second pivot axis as said lifter rotates said spa cover from said flat configuration to said folded configuration, and said first end of said lifter assist is always located further from said pivot axis defined by the mount than said second end of said lifter assist is located from said pivot axis.

18. A spa tub cover and lifter system according to claim 1, wherein:

said pivot axis is located below the rim of the spa tub.

19. A spa tub cover and lifter system according to claim 1, wherein:

in said folded configuration, said outer side of said first cover portion is located vertically below said pivot axis.

20. A spa tub cover and lifter system according to claim 19, wherein:

in said folded configuration, said outer side of said second cover portion is located vertically even with or above the rim of the spa tub.

21. A spa tub cover and lifter system according to claim 5, wherein:

said first support is U-shaped and said second support is U-shaped.

* * * * *